US007159336B2

(12) United States Patent
Burns et al.

(10) Patent No.: US 7,159,336 B2
(45) Date of Patent: Jan. 9, 2007

(54) AMPHIBIOUS SHOE

(75) Inventors: Colleen M. Burns, Snyder, NY (US); Terrence R. Burns, Snyder, NY (US); Anthony Hynes, Lakeview, NY (US); David Moomaw, East Aurora, NY (US); John C. Zoll, Rushford, NY (US)

(73) Assignee: AquaPed, LLC, Snyder, NY (US)

( * ) Notice: Subject to any disclaimer, the term of this patent is extended or adjusted under 35 U.S.C. 154(b) by 119 days.

(21) Appl. No.: 10/503,831

(22) PCT Filed: Jan. 22, 2004

(86) PCT No.: PCT/IB2003/006481

§ 371 (c)(1),
(2), (4) Date: Aug. 6, 2004

(87) PCT Pub. No.: WO2005/079927

PCT Pub. Date: Sep. 1, 2005

(65) Prior Publication Data

US 2005/0153607 A1 Jul. 14, 2005

Related U.S. Application Data

(60) Provisional application No. 60/431,767, filed on Dec. 9, 2002.

(51) Int. Cl.
*A43B 5/08* (2006.01)
*A63B 31/11* (2006.01)

(52) U.S. Cl. ..... 36/8.1; 441/62; 441/64

(58) Field of Classification Search ..... 36/8.1; 441/61, 62, 63, 64
See application file for complete search history.

(56) References Cited

U.S. PATENT DOCUMENTS

| | | | | |
|---|---|---|---|---|
| 4,251,894 | A * | 2/1981 | Hollingsworth | 441/64 |
| 4,264,994 | A * | 5/1981 | Carbone | 441/56 |
| 4,752,259 | A * | 6/1988 | Tackett et al. | 441/64 |
| 4,981,454 | A * | 1/1991 | Klein | 441/62 |
| 5,292,272 | A * | 3/1994 | Grim | 441/62 |
| 5,924,902 | A * | 7/1999 | Burns et al. | 441/64 |
| 6,322,411 | B1 * | 11/2001 | Evans | 441/64 |

FOREIGN PATENT DOCUMENTS

GB 2197796 A * 6/1988

* cited by examiner

*Primary Examiner*—Ted Kavanaugh
(74) *Attorney, Agent, or Firm*—Phillips Lytle LLP

(57) ABSTRACT

An improved amphibious shoe (10) with a swim fin structure which extends for swimming and folds for walking. The amphibious shoe has, in one embodiment, an elastic connection member (27A, 27B) movably connecting the shoe portion (40) of the shoe to the fin portion (20) of the shoe. The elastic connection member maintains the relative positions of the shoe portion and fin portion in a swimming mode and a walking mode. In another embodiment, the shoe portion has a female recess (43A, 43B) for insertion of a corresponding male extension portion (26A, 26B) in the fin portion. Another embodiment includes a locking member (32B, 33B) and a locking plate (34B), wherein the locking plate defines a keyhole slot having a wide portion and a narrow portion, permitting conversion between walking mode and swimming mode when a lateral force is applied.

10 Claims, 13 Drawing Sheets

AMPHIBIOUS SHOE

RELATED APPLICATION

This application is a 371 of PCT/1B03/06481 filed Jan. 22, 2004 which claims priority benefit of U.S. Provisional Application Ser. No. 60/431,767, filed Dec. 9, 2002, which is incorporated herein by reference in its entirety.

TECHNICAL FIELD

The present invention relates generally to footwear for swimming and, more particularly, to an amphibious shoe which may be used for both walking and swimming and which permits simple conversion between a walking mode and a swimming mode.

BACKGROUND ART

Used for swimming and diving, swim fins substantially increase the surface area of the naked foot, thereby increasing the propulsive force of the legs. If used properly, swim fins can conserve a diver's energy and facilitate underwater movement as powerful extensions of a diver's body. In fact, swim fins can be so effective that arms and hands are not necessarily needed for propulsion when skin or scuba diving. However, most swim fins are inconvenient and impractical for walking. Few things feel as awkward as trying to walk while wearing swim fins due to their extended length. Swim fins are cumbersome and can be potentially dangerous while walking.

To overcome this problem, various swim fins have been proposed which include fins capable of folding or rotating between a swimming mode and a walking mode. For example, U.S. Pat. No. 6,155,898 (Burns) discloses an amphibious shoe-like structure with a fin blade surface that expands in a swimming mode and collapses in a walking mode to rest adjacent to a wearer's instep. U.S. Pat. No. 5,924,902 (Burns) discloses a shoe-like structure with an attached one-piece continuous sole-fin structure and a flexible folding zone which facilitates the folding of the sole-fin structure upward.

U.S. Pat. No. 5,292,272 (Grim) discloses a swim fin having a pivoting fin portion which pivots at the toe of the foot pocket. However, walking is still difficult because the non-collapsible fin blade in the retracted state is positioned at a 90 degree angle relative to the longitudinal axis of the foot which increases resistance when walking or wading in shallow water. Likewise, U.S. Pat. No. 4,981,454 (Klein) discloses a swim fin having a retractable fin portion that pivots near the arch of the foot. This pivoting allows the fully expanded fin portion to rise above the instep of the foot where it is positioned adjacent and parallel to the leg. This prevents an awkward upright blade at the toe of the foot pocket, but the large surface area of the fin portion is still in a cumbersome position which reduces flexibility while walking. U.S. Pat. No. 4,752,259 (Tackett) discloses another embodiment having a retractable fin portion wherein the surface area is bifurcated. The frontal end portion of the fin portion pivots upon itself either over or under the foot to facilitate walking. However, only a portion of the fin portion retracts leaving a substantial length extending longitudinally beyond the user's foot which impedes natural ambulation. U.S. Pat. No. 6,540,574 (Haghizume) also discloses a foldable swim fin having a complex apparatus for permitting rotation of the fin portion at or near the arch of the foot.

In order to avoid the disadvantages of such swim fins, it has been proposed to attach a separate and removable fin portion to the shoe-like structure. For example, U.S. Pat. No. 5,041,039 (Chang) discloses a detachable fin portion secured to the sole of the shoe structure by screw means. Likewise, U.S. Pat. No. 5,766,050 (Maggi) discloses a fin portion with a cup-like structure with internal locking means that fits over the toe area of a shoe-structure and seats thereto. However, in such swim fins, the fin portions must be manually attached when needed and when not in use must still be transported by the user, thereby defeating the purpose of easy convertibility between a swimming mode and walking mode. Still further designs for swim fins have been disclosed in U.S. Pat. No. 5,242,321 (Gil) and U.S. Pat. No. 4,250,584 (Korn) wherein collapsible fin portions are provided for easy and compact transport and storage. However, these styles are still not adaptable for walking, and therefore, cannot be converted between a swimming and walking mode.

There is a need, therefore, for an amphibious shoe, which may be used for walking and swimming, having convenient, relatively inexpensive and secure means for converting between a walking mode and a swimming or diving mode and maintaining the amphibious shoe in the desired mode.

DISCLOSURE OF THE INVENTION

With parenthetical reference to the corresponding parts, portions or surfaces of the disclosed embodiment, merely for purposes of illustration and not by way of limitation, the present invention provides an improved amphibious shoe (10) with a swim fin structure (20) which extends for swimming and folds for walking. One aspect of the invention comprises a shoe portion (40) having an upper surface, a fin portion (20), and an elastic connection member movably connecting the shoe portion to the fin portion, which elastic connection member maintains the relative position of the fin portion to the shoe portion when the fin portion is in a first position extending outwardly and generally parallel to the longitudinal axis of the shoe portion, and permits selective movement of the fin portion, upon application of an elongating force, between the first position and a second position wherein the fin portion is adjacent to, or resting upon, the upper surface of the shoe portion (see, FIG. 4). In another aspect, the fin portion may be selectively moved between the above first position and a third position wherein the fin portion is folded beneath the shoe portion generally parallel to the shoe portion (see, FIG. 6). The second and third positions permit walking. The first position is for swimming.

In another aspect of the invention, the amphibious shoe further includes a first fastening member attached to the fin portion (24B) and a second fastening member attached to the shoe portion (42B) whereby the fin portion may be fastened to the shoe portion when folded beneath it in walking mode. In another aspect, the shoe includes a fastening member attached to the shoe portion (41) and a corresponding opening or aperture in the fin portion (23) for insertion of the fastening member, whereby the fin portion may be fastened or held in place when it is in the second position. In yet another aspect of the invention, the amphibious shoe includes a first fastening member attached to the shoe portion and a second fastening member attached to the fin portion whereby the fin portion may be fastened or held in place. This fastener may comprise various mechanical latches or other devices.

In yet another aspect of the invention, the amphibious shoe includes a shoe portion defining a female recess (43A, 43B), a fin portion having a male extension portion (26A, 26B) adapted for insertion into the female recess, and an elastic connection member (27A, 27B) attached to the male extension portion and the shoe portion which elastic connection member extends through the female recess and maintains the relative position of the fin portion to the shoe portion when the fin portion is in a first position extending outwardly and generally parallel to the longitudinal axis of the shoe portion, and permits selective movement of the fin portion, upon application of an elongating force, between the first position and a second position wherein the fin portion is adjacent to the upper surface of the shoe portion. The elastic connection member may be a rubber or other elastic cord, or another elastic component Another aspect provides an amphibious shoe wherein the fin portion may be selectively moved between the first position above and a third position wherein the fin portion is folded beneath the shoe portion generally parallel to the shoe portion. In another aspect, the amphibious shoe comprises a first fastening member (e.g., 24B, 38A, 38B, 39A, 39B, 39C) attached to the fin portion and a second fastening member attached to the shoe portion (e.g., 42B, 46A, 46B, 47A, 47B, 47C) whereby the fin portion may be fastened to the shoe portion when folded beneath.

The invention also contemplates an amphibious shoe with an elastic connection member and a fastening member (41) attached to the shoe portion and a corresponding opening (23) in the fin portion for insertion of the fastening member to hold the fin portion in the second, upwardly folded position. Another aspect includes a first fastening member attached to the shoe portion and a second fastening member attached to the fin portion.

The amphibious shoe may also comprise a shoe portion (40) having an upper surface, a fin portion (20), and a connection apparatus for movably connecting the shoe portion to the fin portion, wherein the connection apparatus comprises a locking member with a cylindrical portion (32B) and a planar portion (33B), and a locking plate (34B), wherein the locking plate defines a keyhole slot (35B) having a wide portion and a narrow portion (see, FIG. 18). In this aspect, the fin portion may be selectively rotated between a first position extending outwardly and generally parallel to the longitudinal axis of the shoe portion and a second position wherein the fin portion is adjacent to the upper surface of the shoe portion, by applying a lateral force to the fin portion away from the shoe portion so as to cause the planar portion of the locking member to move from the narrow portion to the wide portion of the locking plate, allowing for upward or downward rotation.

The amphibious shoe of the present invention also includes, in one aspect, a connection apparatus with locking plate as described above wherein the fin portion may be selectively moved between the first position and a third position wherein the fin portion is folded beneath the shoe portion. Other aspects include a first fastening member attached to the fin portion and a second fastening member attached to the shoe portion allowing the fin portion to be fastened to the shoe portion when it is folded beneath (see, FIGS. 19–23). Also, a fastening member attached to the shoe portion with a corresponding opening for insertion of the fastening member through the fin portion. In another aspect, the amphibious shoe includes a connection apparatus as described with a first fastening member attached to the shoe portion and a second fastening member attached to the fin portion, whereby the fin portion may be fastened to the shoe portion when the fin portion is folded upward.

In other aspects, the locking member comprises a cylindrical portion (32B) and a planar portion (33B) which may be inserted through said locking plate (34B). In another aspect, the connecting apparatus further comprises a spring creating a lateral force sufficient to maintain the fin portion in swimming mode absent application to the fin portion of a greater lateral force away from the shoe portion.

A principal object of the present invention is to provide an amphibious shoe suitable for swimming and walking. Another object is to provide a shoe that is lightweight and can easily be converted between a walking mode and a swimming mode.

Yet another object of the present invention is to provide a two-piece amphibious shoe structure wherein a fin portion is coupled to a shoe portion such that such portions may be securely fastened in both walking mode and swimming mode. Still another object of the present invention is to provide an amphibious shoe having a fin portion which pivots at or near the front of the shoe portion.

These and other objects and advantages will become apparent from the foregoing and ongoing written specification, the accompanying drawings and the appended claims.

DESCRIPTION OF THE PREFERRED EMBODIMENTS

Figure 1:
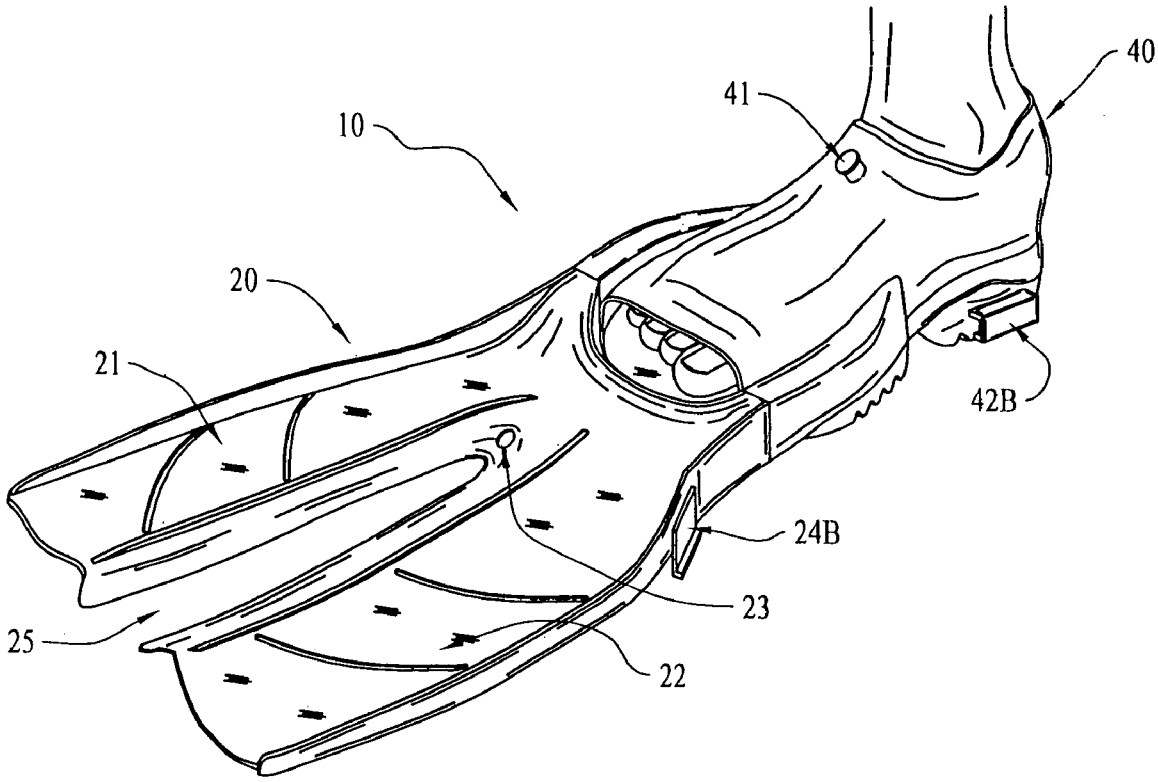
FIG. 1 is a perspective view of the amphibious shoe of the present invention illustrating insertion of a foot.

At the outset, it should be clearly understood that like reference numerals are intended to identify the same structural elements, parts, portions or surfaces consistently throughout the several drawing figures, as such elements, parts, portions or surfaces may be further described or explained by the entire written specifications, of which this detailed description is an integral part. Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

Referring now to the drawings, FIG. 1 is a perspective view of the amphibious shoe 10 of the present invention which illustrates insertion of a right foot into the shoe portion 40 of the invention. The fin portion 20 in this embodiment comprises two flap portions 20, 21 which define a recess 25 in the distal end portion of the fin portion 20. Alternate embodiments of the invention include a one-piece fin portion (see, e.g., FIGS. 19–21). In this embodiment, the fin portion defines a hole or opening 23 used to fasten the fin portion 20 to the shoe portion 40 when the fin portion is rotated or folded upward (see, FIG. 5). In such folded position, a fastening member 41 attached to the shoe portion is extended through the opening 23 to hold the fin portion 20 securely in place. In this embodiment, the fastening member 41 is a cylindrical-shaped latch with a cap on its outwardly facing end having a diameter greater than the main body of the latch, thereby maintaining the flexible fin portion in such folded position unless sufficient outward force is applied to rotate or move the fin portion.

FIG. 1 also illustrates a side fastening member 24B attached to the fin portion which corresponds to a second side fastening member 42B on the heel of the shoe portion. These fastening members provide for securely joining the fin portion to the shoe portion when the fin portion is folded beneath the shoe portion to allow for walking (see, FIG. 6).

Figure 2:
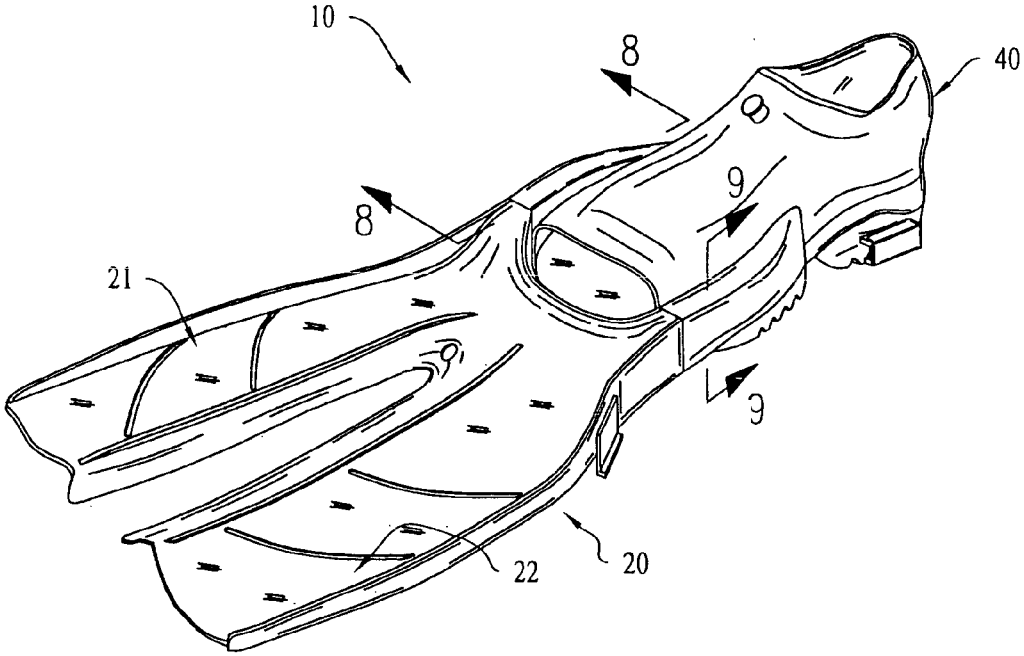
FIG. 2 is a perspective view of the amphibious shoe.

FIG. 2 is another perspective view of the amphibious shoe 10 of the present invention, illustrating the fin portion 20 and shoe portion 40 in an engaged position and further indicating the cross-sectional views later illustrated in FIGS. 8 and 9. Additional mechanical locking mechanisms of various types, such as a latch or détente, may be included which secure the fin portion in this engaged position.

Figure 3:
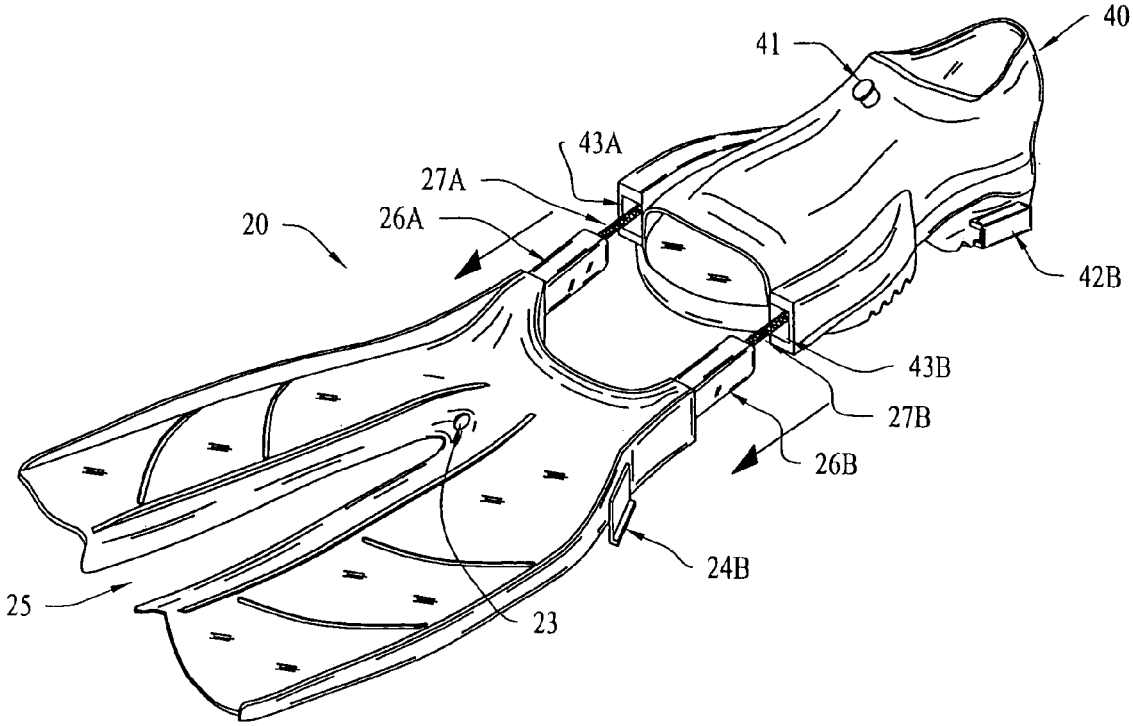
FIG. 3 is a perspective view of the amphibious shoe illustrating a preferred connection member.

FIG. 3 illustrates a preferred embodiment of the present invention wherein the shoe portion 40 defines female recesses 43A, 43B on the side of the shoe portion near the frontal toe portion. In this embodiment, these female recesses 43A, 43B are configured to receive corresponding male extension portions 26A, 26B of the fin portion 20. In this embodiment, the male extension portions 26A, 26B have a rectangular cross-section corresponding to the rectangular cross-sectional opening in the female recesses 43A, 43B. However, the cross-sectional shape of such elements may be modified as long as the cross-sections of the male extension portions correspond to those of the female recesses, preventing rotation of the fin portion when engaged. An elongated elastic connection member, or elastic cord in this embodiment 27A, 27B is attached to each male extension portion 26A, 26B, extends through each female recess 43A, 43B, at the rear of which the elastic connection member is attached to the shoe portion 40. This elastic connection member may be a rubber cord or such other element, such as a spring, having an elasticity such that the connection member may be extended by an elongating or tension force to permit movement of the fin portion relative to the shoe portion at least between a first position wherein the full length of the male extension portions 26A, 26B are extended into the corresponding female recess portions 43A, 43B, and a second fastened position wherein the latch 41 on the shoe portion 40 extends through the opening 23 in the fin portion 20. The elasticity must also be such that the connection member maintains the relative positions of the fin portion and shoe portion while swimming (i.e., in the engaged position). In certain embodiments, the elastic connection member 27A, 27B must also be of an elasticity such that the fastening member 24B of the fin portion 20 may be joined with the fastening member 42B on the heel of the shoe portion 40.

Figure 4:
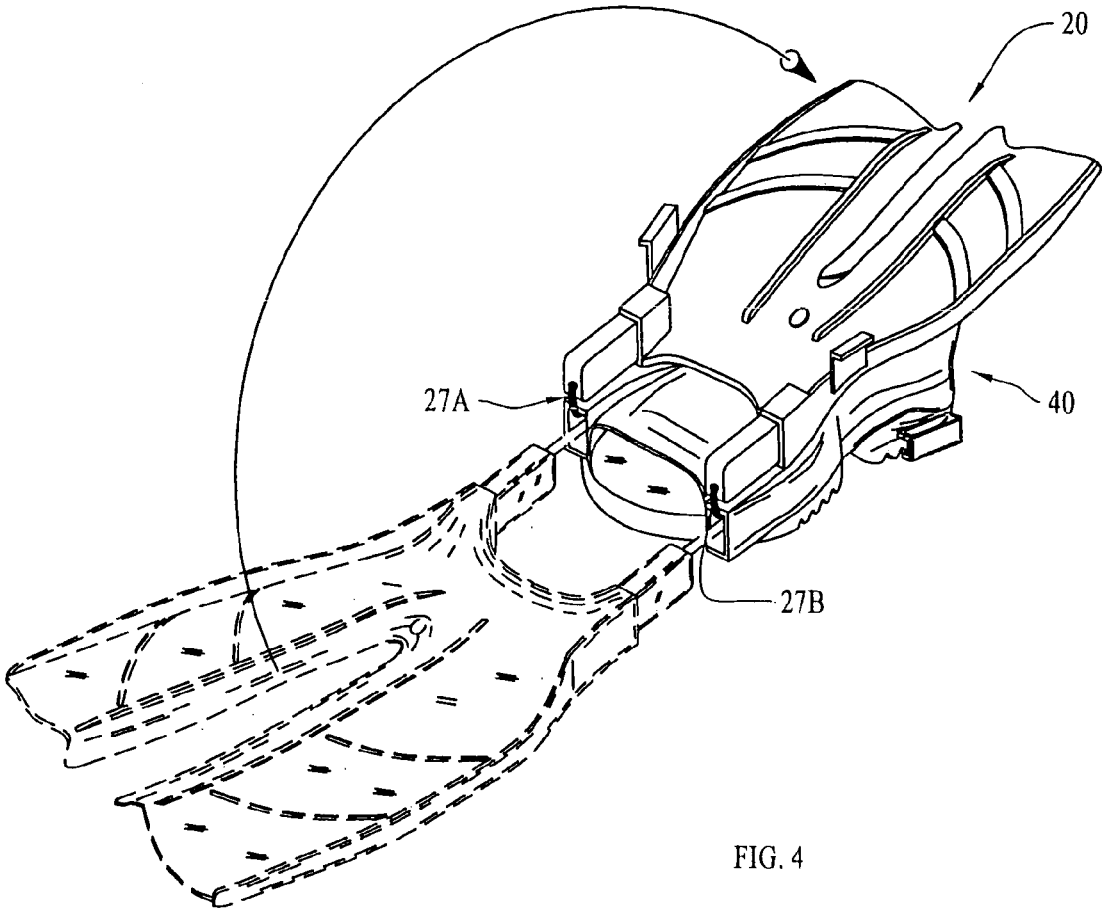
FIG. 4 is a perspective view of the amphibious shoe illustrating upward folding motion.
Figure 5:
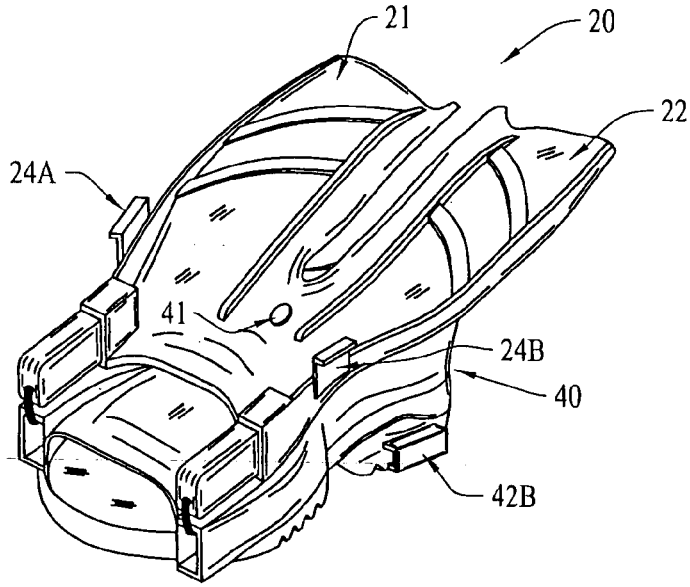
FIG. 5 is a perspective view of the amphibious shoe illustrating the fin portion as secured to the shoe portion.

FIG. 4 illustrates the folding or rotating of the fin portion 20 upward from the first engaged position to a second position wherein the fin portion 20 rests adjacent to the top surface of the shoe portion 40, and the latch 41 extends through the corresponding opening 23 in the fin portion. FIG. 4 also illustrates the flexing or elongation of the elastic connection members 27A, 27B. FIG. 5 is a further perspective view of the upwardly folded fin portion 20 in the described second position. In the illustrated embodiment, the flap portions 21, 22 may extend around two side of a wearer's leg. Another embodiment includes a solid, one-piece fin portion shorter than a conventional swim fin to permit upward folding without reaching or straddling a wearer's leg.

Figure 6:
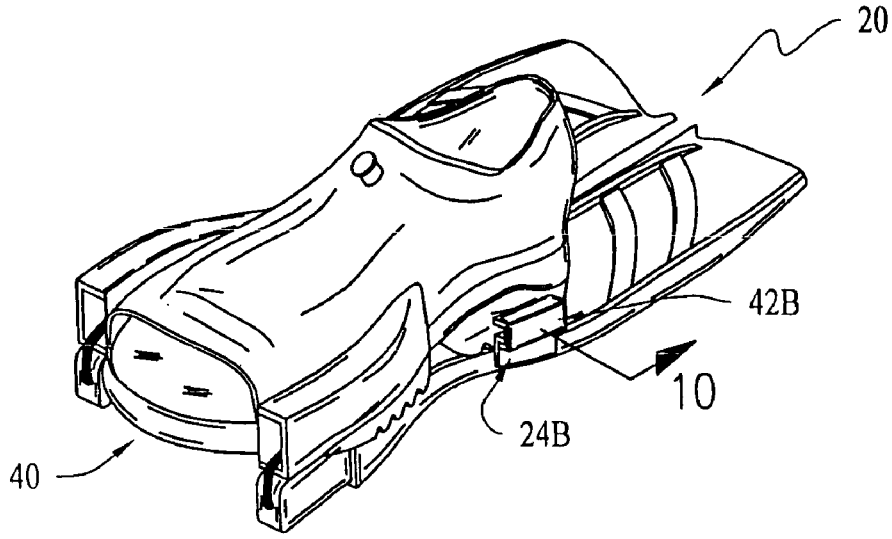
FIG. 6 is a perspective view of the amphibious shoe illustrating downward folding and fastening of the fin portion.
Figure 7:
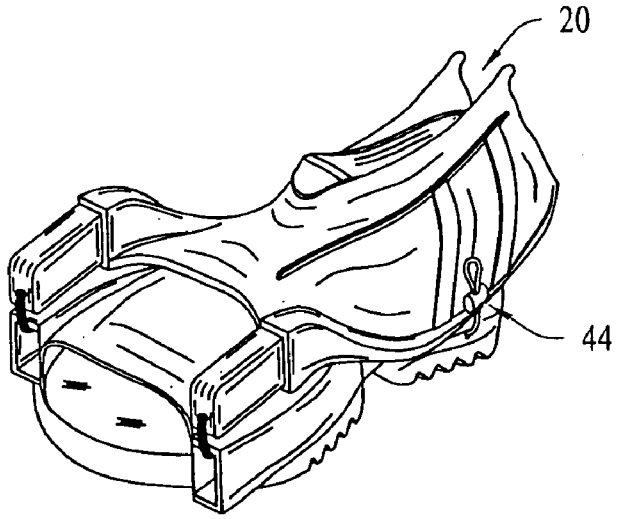
FIG. 7 is a perspective view of the amphibious shoe illustrating an embodiment for securing the fin portion to the shoe portion.
Figure 10:
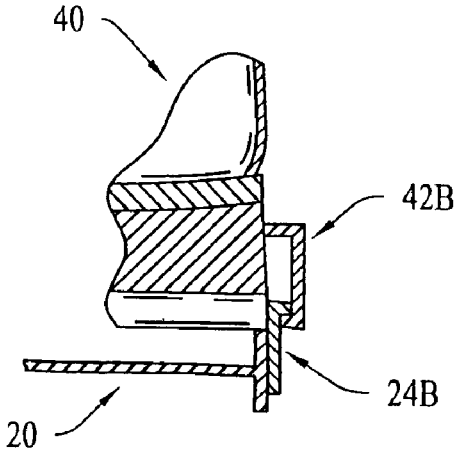
FIG. 10 is a rear cross-sectional view of the amphibious shoe illustrating the embodiment in FIG. 6.

FIG. 6 illustrates a third position wherein the fin portion is folded beneath and generally parallel to the shoe portion 40. In this embodiment, corresponding fastening members 24B, 42B are joined to hold the fin portion 20 in place for walking. In this embodiment, the fastening member attached to the fin portion 24B is an L-shaped member and the fastening member 42B attached to the shoe portion 40 is a C-shaped member which clasps the outwardly-directed part of the L-shaped fastening member 24B. The fin portion may also be a one-piece non-bifurcated construction. FIG. 7 illustrates an alternative fastening member 44 which maintains the fin portion 20 in an upwardly folded position. In this embodiment, the fastening member 44 includes a loop made through an opening or hole defined in a cylindrical fastening body. FIG. 10 is a rear cross-sectional view of the embodiment shown in FIG. 6 which illustrates the joinder of a fastening member 24B connected to the fin portion 20 with a C-shaped fastening member 42B of the shoe portion 40.

Figure 8:
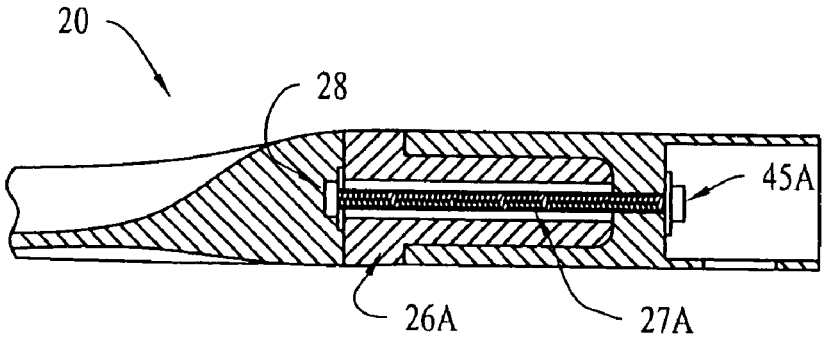
FIG. 8 is a side cross-sectional view of the amphibious shoe illustrating a preferred embodiment for connecting the fin portion to the shoe portion.
Figure 9:
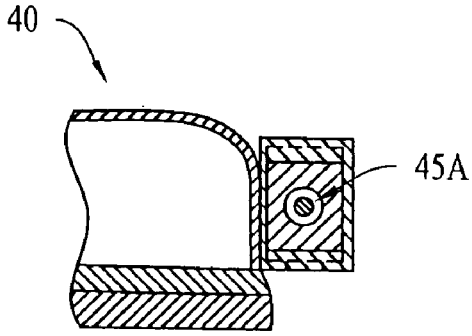
FIG. 9 is a cross-sectional view of the amphibious shoe illustrating the embodiment in FIG. 8.

FIG. 8 is a side cross-sectional view of the amphibious shoe 10 illustrating a preferred elastic connection member 27A. While not illustrated, an identical or equivalent connection member 27B extends through the other female recess 43B and is attached to the other male extension portion 26B. FIG. 8 illustrates the connection member when the fin portion is in an engaged or closed position with respect to the shoe portion 40. In other words, the male extension portion 26A is generally fully extended into the corresponding female recess 43A. The elastic connection member is secured to the shoe portion by virtue of an end cap 45A having a diameter greater than the corresponding aperture in the shoe portion through which the connection member extends. A corresponding end cap 28 attaches the connection member to the fin portion 20 as illustrated. FIG. 9 is a cross-sectional view of the same elastic connection member illustrating the end cap 45A attached to the shoe portion 40.

Figure 11:
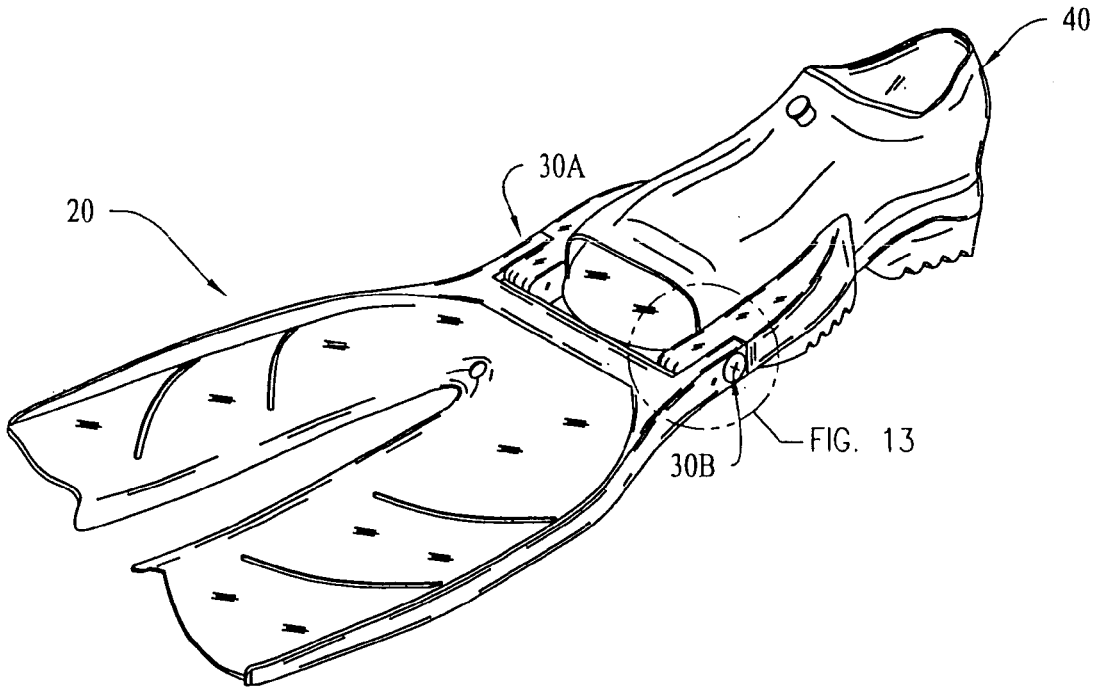
FIG. 11 is a perspective view of the amphibious shoe illustrating an alternative embodiment for connecting the fin portion and the shoe portion.
Figure 12:
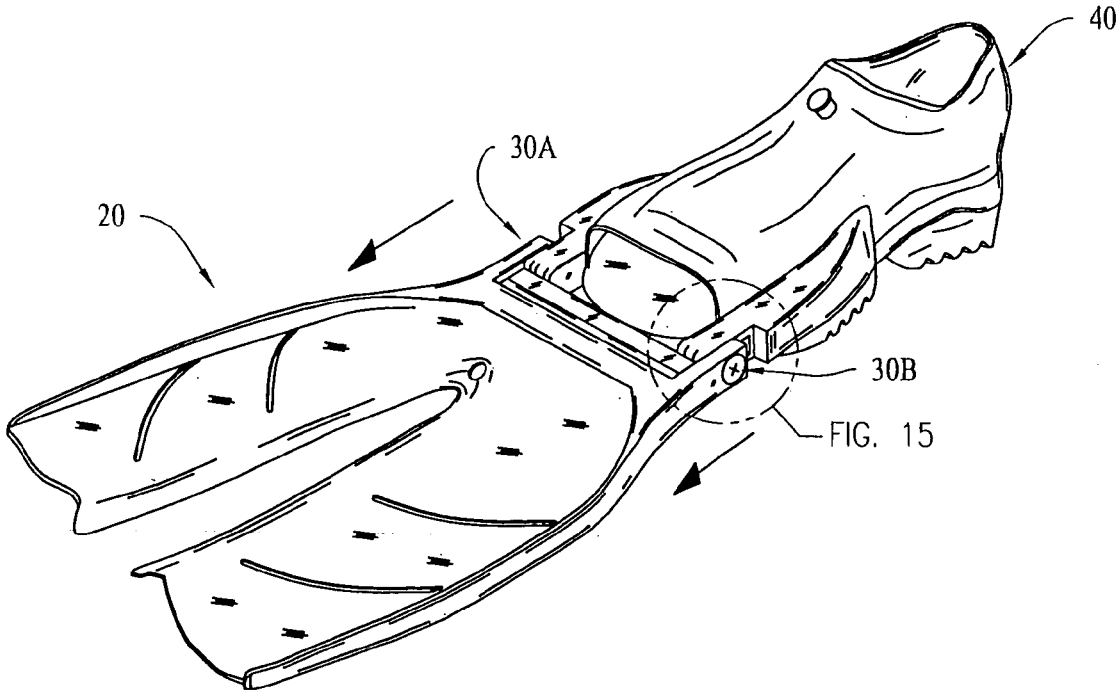
FIG. 12 is a perspective view of the amphibious shoe illustrating FIG. 11 when a lateral force has been applied.

FIG. 11 illustrates another embodiment of the amphibious shoe 10 of the present invention, having a connection apparatus for movably connecting the shoe portion 40 to the fin portion 20 wherein the fin portion may be selectively rotated between a first, engaged position wherein the fin portion extends outwardly and generally parallel to the longitudinal axis of the shoe portion 40, and a second position wherein the fin portion 20 is folded or rotated upwardly until it is adjacent with the upper surface of the shoe portion 40. FIG. 11 illustrates a securing screw or nut 30A, 30B which holds the connection apparatus, illustrated in greater detail in FIGS. 13–18, in place. FIG. 12 illustrates the position of securing nuts 30A, 30B of the connection apparatus when a lateral force is applied to the fin portion in a direction away from the shoe portion 40. From this position, the fin portion 20 may be selectively moved or rotated upwardly. In some embodiments, the fin portion 20 may also be rotated downwardly and beneath the shoe portion 40. The invention contemplates one such connection apparatus on each side of the amphibious shoe.

Figure 13:
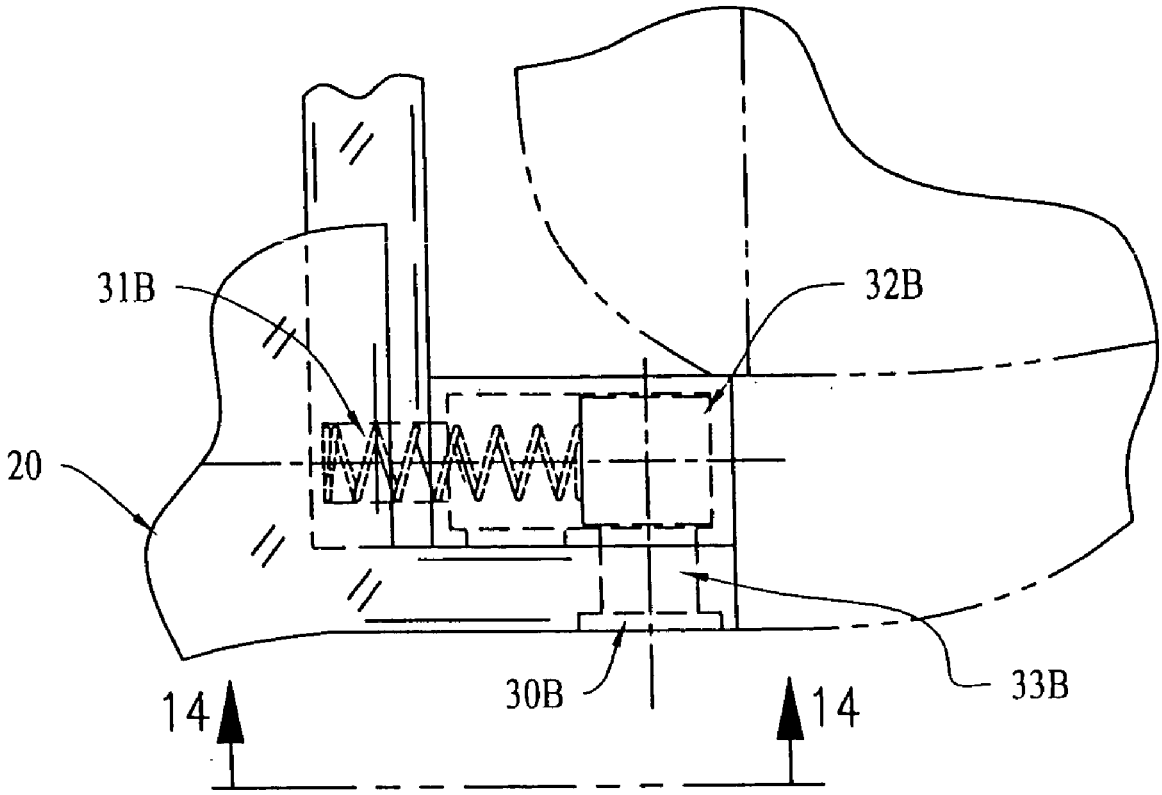
FIG. 13 is a top cross-sectional view of the connection apparatus of FIG. 11.
Figure 14:
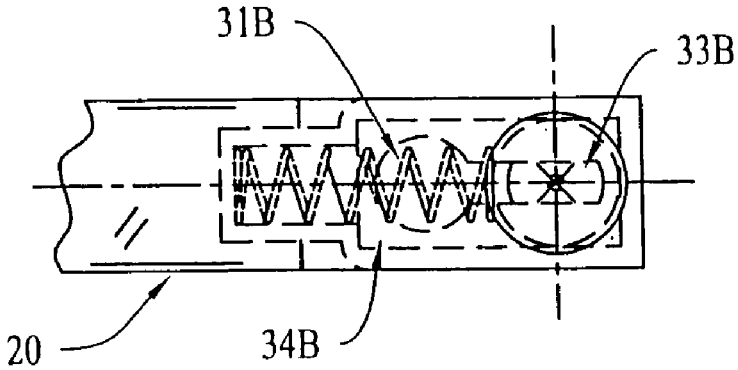
FIG. 14 is a side cross-sectional view of FIG. 13.
Figure 15:
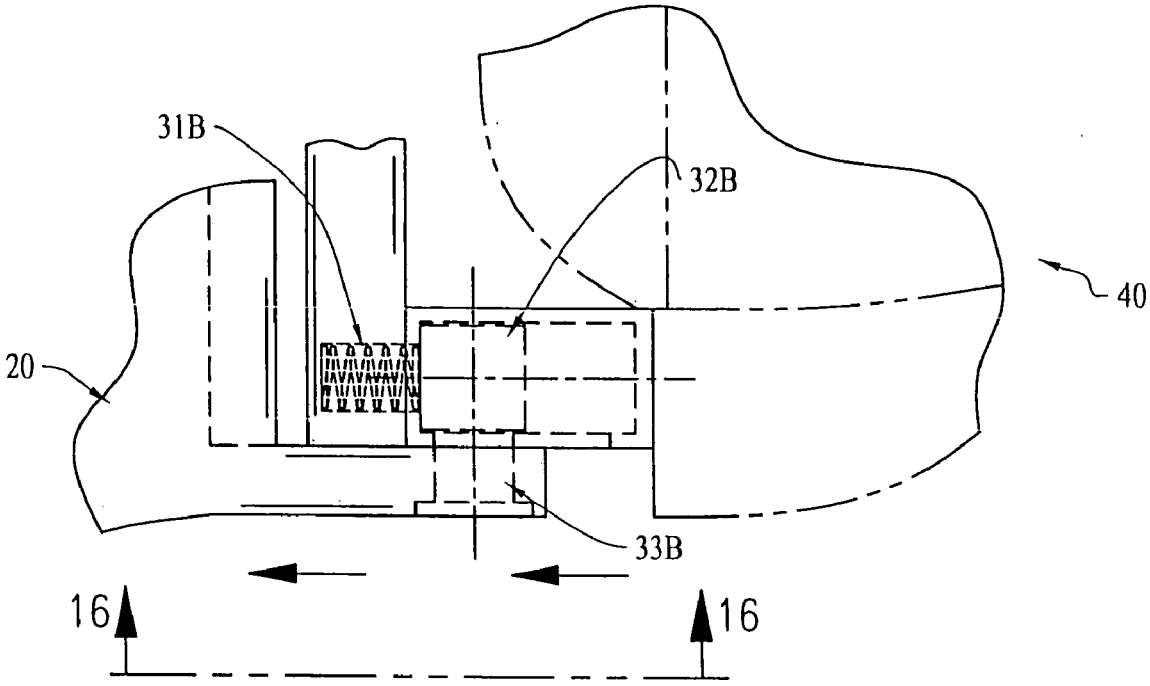
FIG. 15 is a top cross-sectional view of the amphibious shoe of FIG. 13 when a lateral force has been applied.

FIG. 13 is a top view of the connection apparatus on the right side of the amphibious shoe 10 of FIG. 11. This figure illustrates a coil spring 31B which applies lateral pressure to a locking member comprised of a cylindrical portion 32B and a planar portion 33B. In this figure, the fin portion is in an engaged position extending outwardly and generally parallel to the longitudinal axis of the shoe portion. In order to release the fin portion 20 from this engaged position, a lateral force must be applied to compress the coil spring 31B, as shown in FIG. 15. FIG. 14 is a side cross-sectional view of the connection apparatus of FIG. 13 which also illustrates the spring 31B. In addition, FIG. 14 illustrates extension of the planar portion 33B of the locking member through a locking plate 34B having a keyhole slot (as illustrated in FIG. 18).

Figure 16:
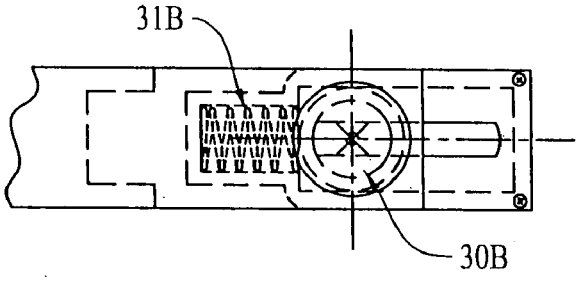
FIG. 16 is a side cross-sectional view of FIG. 15.
Figure 17:
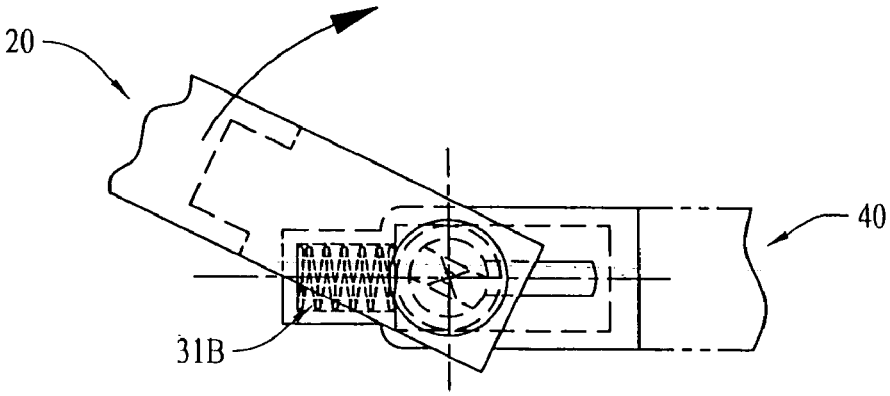
FIG. 17 is a side cross-sectional view of the amphibious shoe illustrating rotation of the fin portion.

As indicated, FIG. 15 illustrates the connection apparatus when a lateral force has been applied to the fin portion 20. Under these conditions, the spring 31B is compressed such that the locking member moves laterally away from the shoe portion 40, causing the planar portion 33B of the locking member to enter a wide portion of the keyhole slot, as illustrated in FIGS. 16 and 18. This permits rotation of the fin portion 20 (and the locking member) from the engaged, generally parallel position to a second position rotating upward from the shoe portion 40, as shown in FIG. 17, or a third position rotating downward.

Figure 18:
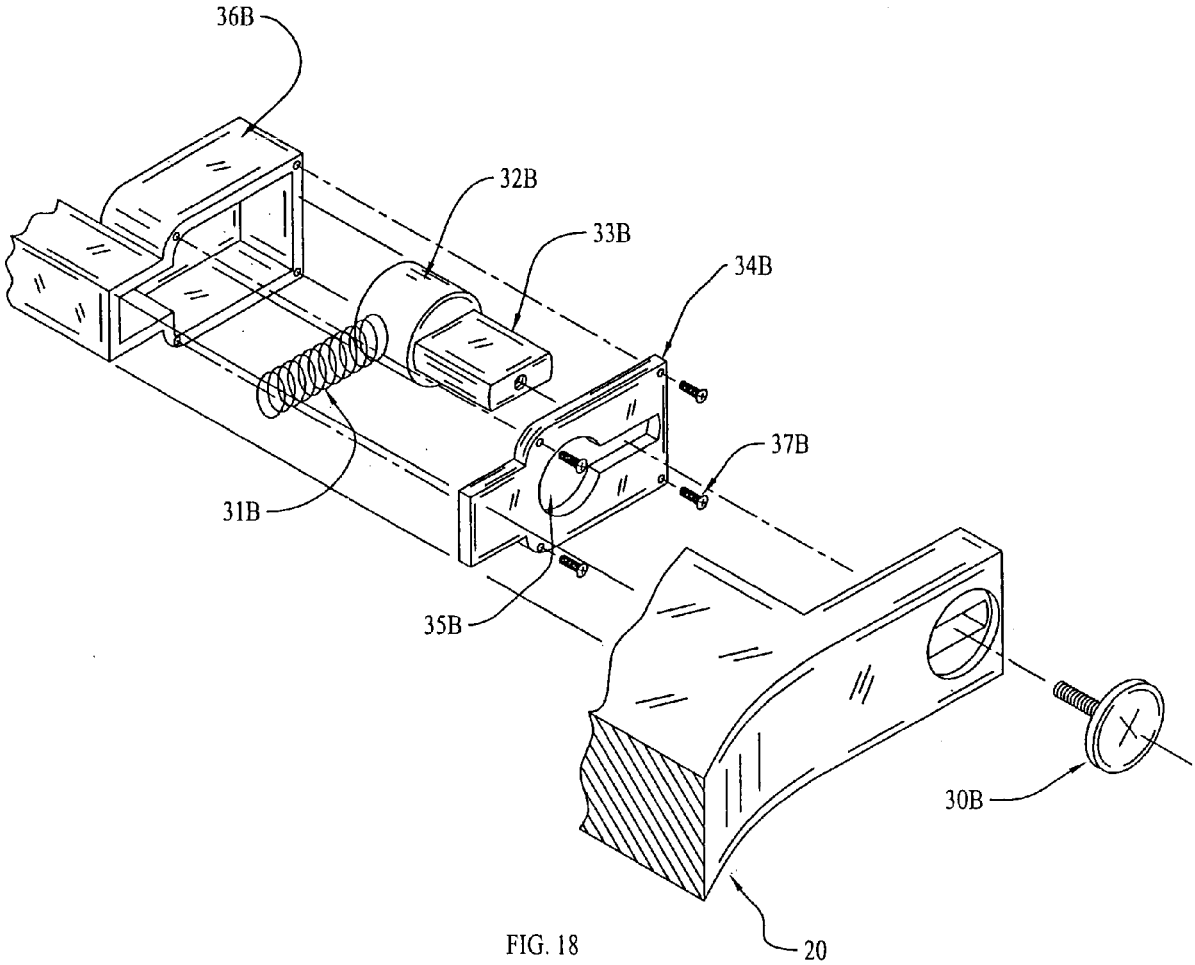
FIG. 18 is an exploded view of the preferred embodiment illustrated in FIGS. 11 through 17.

FIG. 18 is an exploded view of the connection apparatus. As illustrated, the locking member, comprised of the cylindrical portion 32B and the planar portion 33B, is attached to a coil spring 31B such that the planar portion 33B may extend through the keyhole slot 35B of the locking plate 34B until the locking plate 34B abuts the cylindrical portion 32B. When a lateral force is applied to the locking member, the planar portion 33B moves from the narrow portion of the keyhole slot to the wider, in this case circular, portion of the keyhole slot 35B, thereby permitting rotation of the locking member and the entire fin portion 20. The locking plate 34B is secured to an internal portion 36B of the fin portion with screws 37B or other suitable means, such as an adhesive.

Figure 19:
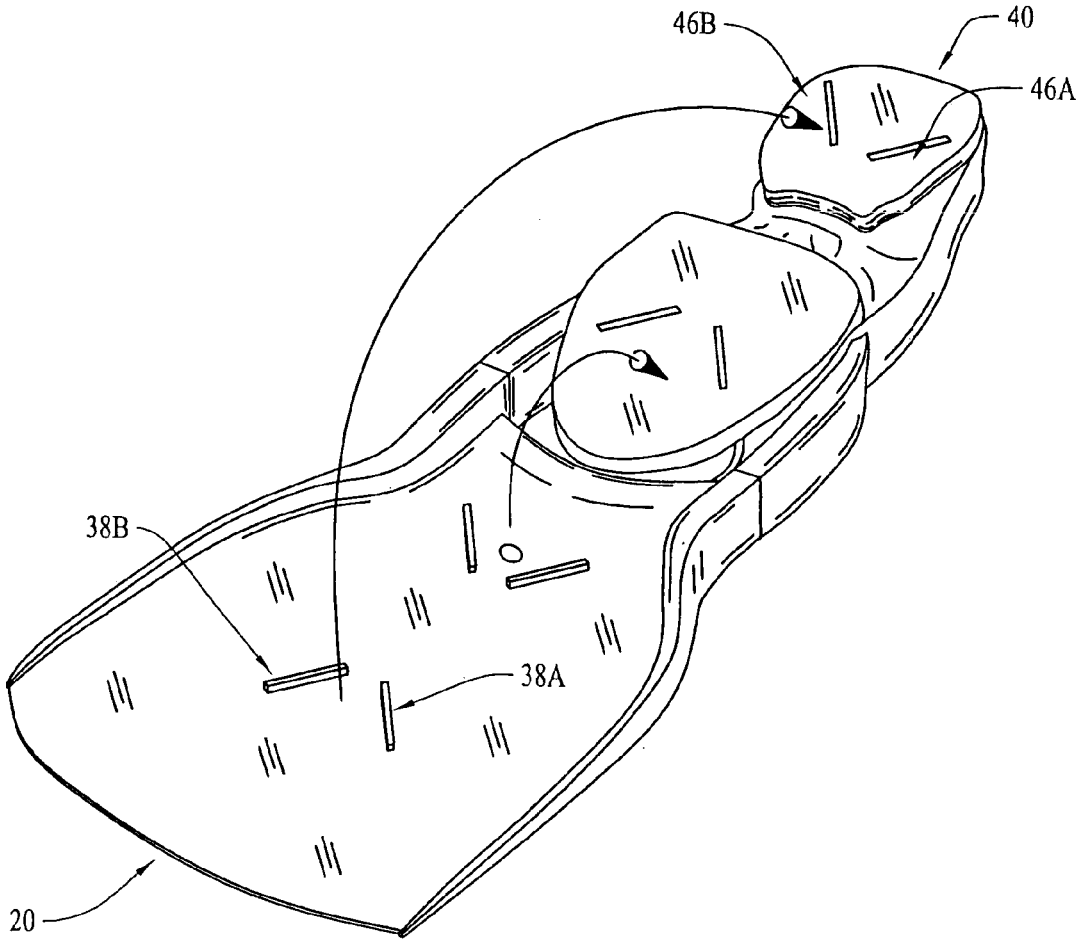
FIG. 19 is a bottom perspective view of the amphibious shoe illustrating a preferred means for fastening.

FIG. 19 illustrates a means for fastening the fin portion 20 to the shoe portion 40 when the fin portion is rotated beneath the shoe portion. In this embodiment, rectangular fastening members 38A, 38B protruding from the bottom of the fin portion are inserted into corresponding depressions or cavities 46A, 46B in the sole and heel of the shoe portion 40.

Figure 20:
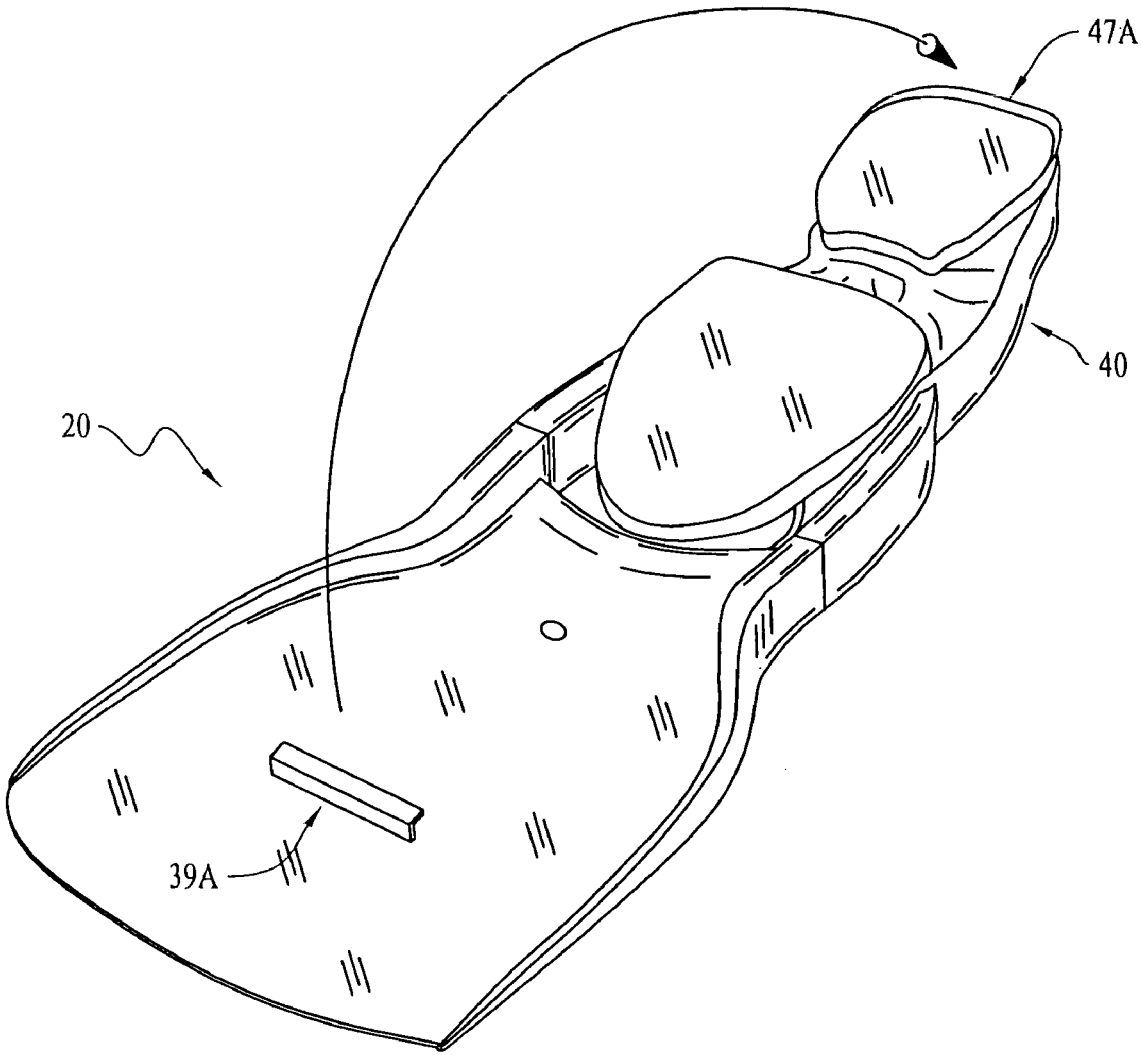
FIG. 20 is a bottom perspective view of the amphibious shoe illustrating an alternative preferred means for fastening.
Figure 21:
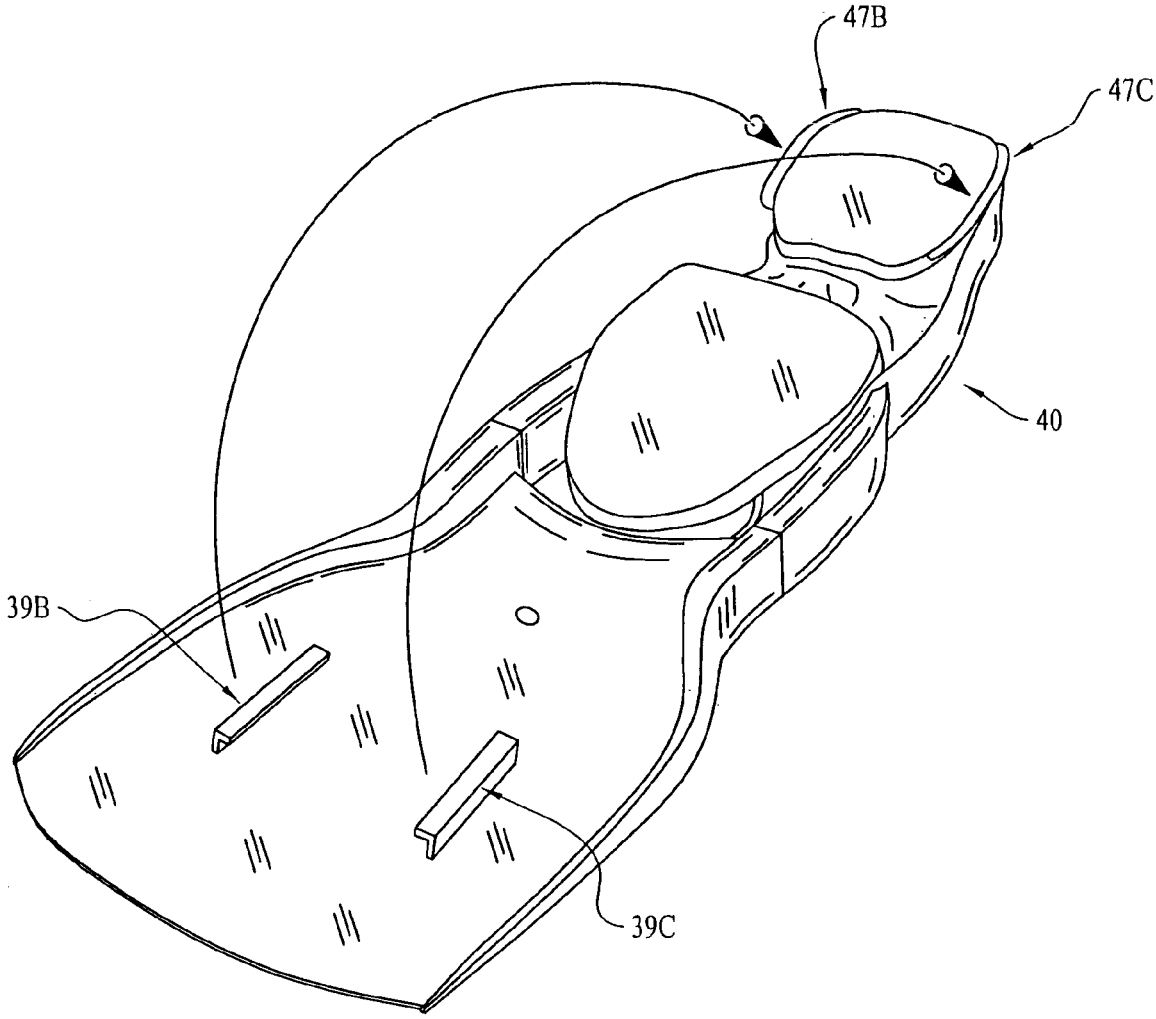
FIG. 21 is a bottom perspective view of the amphibious shoe illustrating an alternative preferred means for fastening.

In FIG. 20, an alternate means for fastening the fin portion 20 to the shoe portion 40 when the fin portion is rotated beneath the shoe portion is illustrated. In this embodiment, an L-shaped latch 39A may be attached to a flange 47A extending from the rear base of the heel of the shoe portion 40. FIG. 21 illustrates a similar embodiment wherein two L-shaped latches 39B, 39C may be coupled with two flanges 47B, 47C extending from the sides of the base of the heel of the shoe portion 40.

Figure 22:
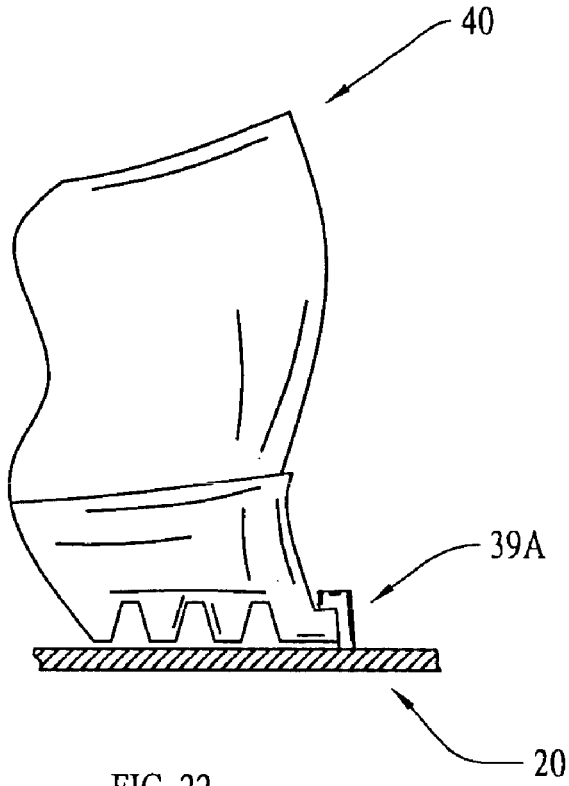
FIG. 22 is a side view of the embodiment in FIG. 20.
Figure 23:
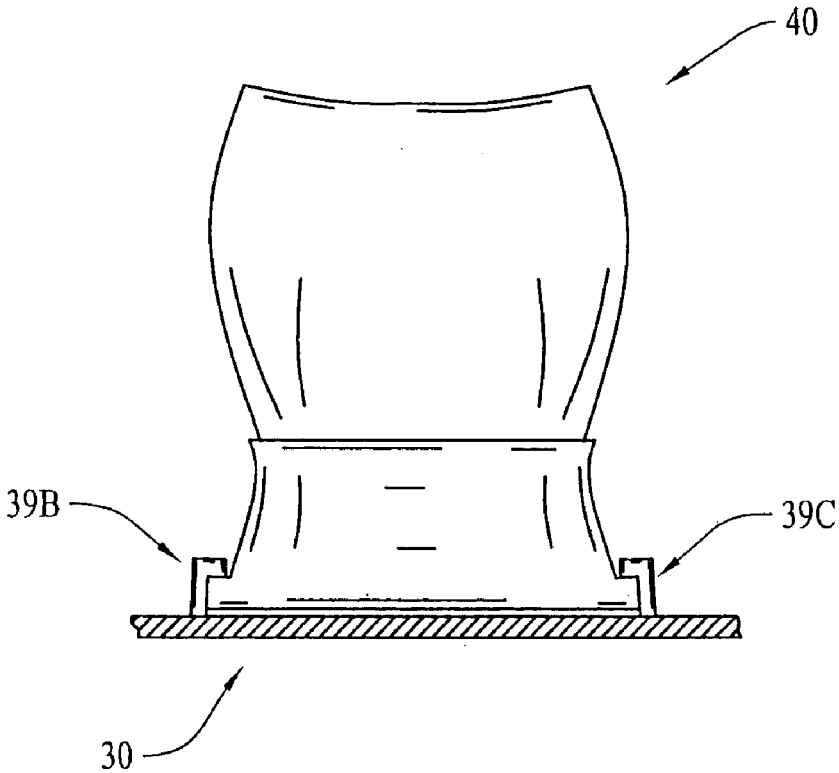
FIG. 23 is a rear view of the embodiment in FIG. 21.

FIG. 22 is a side view of the fastening means illustrated in FIG. 20. Similarly, FIG. 23 is a rear view of the fastening means illustrated in FIG. 21.

While there has been described what is believed to be the preferred embodiment of the present invention, those skilled in the art will recognize that other and further changes and modifications may be made thereto without departing from the spirit of the invention Therefore, the invention is not limited to the specific details and representative embodiments shown and described herein. Accordingly, persons skilled in this art will readily appreciate that various additional changes and modifications may be made without departing from the spirit or scope of the invention, as defined and differentiated by the following claims. In addition, the terminology and phraseology used herein is for purposes of description and should not be regarded as limiting.

What is claimed is:

1. An amphibious shoe, comprising:

a shoe portion having an upper surface and defining a female recess;

a fin portion having a male extension portion adapted for insertion into said female recess; and an elastic connection member attached to said male extension portion and said shoe portion which elastic connection member extends through said female recess and maintains the relative position of said fin portion to said shoe portion when said fin portion is in a first position extending outwardly and generally parallel to the longitudinal axis of said shoe portion, and permits selective movement of said fin portion, upon application of an elongating force, between said first position and a second position wherein said fin portion is adjacent to said upper surface of said shoe portion wherein said elastic connection member remains attached to both said male extension portion and said shoe portion when said fin portion is in said second position.

2. The amphibious shoe of claim 1 wherein said fin portion may be selectively moved between said first position and a third position wherein said fin portion is folded beneath said shoe portion generally parallel to said shoe portion.

3. The amphibious shoe of claim 2, further comprising:

a first fastening member attached to said fin portion and a second fastening member attached to said shoe portion;

whereby said fin portion may be fastened to said shoe portion when said fin portion is in said third position.

4. The amphibious shoe of claim 1, further comprising:

a fastening member attached to said shoe portion;

wherein said fin portion defines a corresponding opening for insertion of said fastening member, whereby said fin portion may be fastened to said shoe portion when said fin portion is in said second position.

5. The amphibious shoe of claim 1, further comprising:

a first fastening member attached to said shoe portion and a second fastening member attached to said fin portion;

whereby said fin portion may be fastened to said shoe portion when said fin portion is in said second position.

6. An amphibious shoe, comprising:

a shoe portion having an upper surface and defining a female recess;

a fin portion having a male extension portion adapted for insertion into said female recess; and an elastic cord attached to said male extension portion and said shoe portion which elastic cord extends through said female recess and maintains the relative position of said fin portion to said shoe portion when said fin portion is in a first position extending outwardly and generally parallel to the longitudinal axis of said shoe portion, and permits selective movement of said fin portion, upon application of an elongating force, between said first position and a second position wherein said fin portion is adjacent to said upper surface of said shoe portion.

7. The amphibious shoe of claim 6 wherein said fin portion may be selectively moved between said first position and a third position wherein said fin portion is folded beneath said shoe portion generally parallel to said shoe portion.

8. The amphibious shoe of claim 6, further comprising:

a first fastening member attached to said fin portion and a second fastening member attached to said shoe portion;

whereby said fin portion may be fastened to said shoe portion when said fin portion is in said third position.

9. The amphibious shoe of claim 6, further comprising:

a fastening member attached to said shoe portion;

wherein said fin portion defines a corresponding opening for insertion of said fastening member, whereby said fin portion may be fastened to said shoe portion when said fin portion is in said second position.

10. The amphibious shoe of claim 6, further comprising:

a first fastening member attached to said shoe portion and a second fastening member attached to said fin portion;

whereby said fin portion may be fastened to said shoe portion when said fin portion is in said second position.

* * * * *